United States Patent [19]

Ruble et al.

[11] Patent Number: 4,964,242

[45] Date of Patent: Oct. 23, 1990

[54] APPARATUS FOR TEXTURING RIGID-DISKS USED IN DIGITAL MAGNETIC RECORDING SYSTEMS

[75] Inventors: Frank D. Ruble, Saratoga; Roger R. Stearman, San Mateo; Robert A. Smith, Berkeley, all of Calif.

[73] Assignee: Exclusive Design Company

[21] Appl. No.: 410,987

[22] Filed: Sep. 22, 1989

[51] Int. Cl.[5] ..... B24B 21/12; B24B 5/00; B24B 7/00

[52] U.S. Cl. ..... 51/144; 51/145 R; 51/281 SF; 51/88

[58] Field of Search ..... 51/150, 154, 155, 141, 51/144, 145 R, 62, 281 SF, 88, 89, 165.77, 165.78

[56] References Cited

U.S. PATENT DOCUMENTS

| | | | |
|---|---|---|---|
| 1,843,301 | 2/1932 | Player | 51/289 R |
| 3,481,083 | 12/1969 | David | 51/62 |
| 4,145,846 | 3/1979 | Howland | 51/141 X |
| 4,262,452 | 4/1981 | Lopez | 51/281 SF X |
| 4,347,689 | 9/1982 | Hammond | 51/145 R X |
| 4,535,567 | 8/1985 | Seaborn | 51/145 R X |
| 4,656,790 | 4/1987 | Mukai | 51/141 |

*Primary Examiner*—D. S. Meislin
*Assistant Examiner*—Bruce P. Watson
*Attorney, Agent, or Firm*—Blakely, Sokoloff, Taylor & Zafman

[57] ABSTRACT

An apparatus for texturing the front and back surfaces of a rigid-disk substrate used in magnetic recording systems is disclosed. The apparatus comprises first and second mechanical assemblies; each of the assemblies including an abrasive tape, a load-bearing roller member, and a means for moving said tape over said roller member. Each assembly further includes a means for applying various components of force to the roller members to abrasively press the tape against the substrate surface. The invented apparatus also includes a network for mechanically coupling each of the assemblies together such that the applied force components are identical for both the front and back surfaces of the substrate. The applied forces are made independent of the substrate's position or displacement.

17 Claims, 9 Drawing Sheets

APPARATUS FOR TEXTURING RIGID-DISKS USED IN DIGITAL MAGNETIC RECORDING SYSTEMS

RELATED APPLICATIONS

This application is related to an application entitled "Automated Rigid-Disk Surface Finishing System Providing In-Line Process Control", Ser. No. 07/410,952 filed 9/22/89, which application is assigned to the assignee of the present application.

FIELD OF THE INVENTION

This invention relates to the field of the electromechanical systems for texturing and finishing the surfaces of rigid-disks.

BACKGROUND OF THE INVENTION

In present day data processing systems, it is desirable to provide a large amount of memory which can be accessed in a minimal amount of time. One type of memory which has enjoyed widespread use in the data processing field is that of magnetic media disk memories.

In general, disk memories are characterized by the use of one or more magnetic media disks stacked on a spindle assembly and rotated at a high rate of speed. Each disk is divided into a plurality of concentric "tracks"with each track being an addressable area of the memory array. The individual tracks are accessed through magnetic "heads" which fly over the disk on a thin layer of air. Typically, the disks are two-sided with a head accessing each side. In operation, these magnetic recording heads recover digital information from the recorded media by detecting magnetic flux reversals written onto the media.

Because of the small spacings and narrow tolerances involved in rigid-disk recording systems, the most important properties needed in advanced media are generally of a mechanical nature. Substrate and coating surfaces must be smooth to reduce noise and to reduce head-to media spacing. Mechanical wear resistance and magnetic uniformity are highly important for all types of media, but especially so for thin films or thin particular coatings. This means that the texturing process, which provides uniform microscopic grooves across the surface of the disk, is crucial to magnetic recording systems with high information density.

Texturing improves the properties of the magnetic rigid-disk in several ways. First of all, texturing removes the possibility of a Johansson Block effect occurring between the recording head and the disk surface. The Johansson Block effect refers in part to the tendency of the magnetic recording head to stick to a perfectly flat substrate surface due to the relative vacuum formed in between. The grooves prevent a vacuum from forming by allowing air molecules to penetrate the head/disk interface. The grooves, therefore, are essential to avoiding cohesion between the disk and head which may prevent the drive spindle from turning after a standstill.

The microscopic grooves also act as a reservoir for loose organic particulate matter which may find its way onto the disk's surface. In this way, the grooves function as tiny ditches to drain away contaminants from the disk surface where they might interface physically or electrically with the head-media interface.

Another purpose of texturing is to enhance the magnetic properties of the rigid-disk surface by reducing the radial component of magnetization while intensifying the circumferential component. A large circumferential component of magnetization results in better differentiation between adjacent tracks on the magnetic surface.

In the course of manufacturing a magnetic disk, the substrate is first plated with nickle to a thickness of about 0.5 to 1.0 thousands of an inch and polished to a mirror finish. Standard substrate materials for rigid-disk recording media include high-purity aluminum and aluminum (4–5%) magnesium alloys. These substrate materials provide a uniform smooth surface which permits close head-to-media spacing in addition to reducing substrate-induced noise.

The next manufacturing step involves the actual texturing of the disk surface. The purpose of texturing, as mentioned, is to improve the physical and magnetic properties of the recording surface. In the texturing process, numerous microscopic grooves are cut circumferential into the disk's surface using either a fixed-abrasive or free-abrasive medium. In general, the grooves measure approximately 12×12 microinches in dimension. Each groove is separated from its nearest neighbor by approximately 20–30 microns. (Practically, the grooves are not located on a true circumference of the disk. Rather, the grooves are cross-hatched—intersecting at an approximate 10 degree angle to each other.)

Most texturing equipment utilizes an abrasive mineral, such as silicon carbide or aluminum oxide, for cutting the grooves. The mineral is bonded to a mylar-backed tape which is then passed over a cylindrical load roller. The tape is mechanically forced against the surface of the disk by the load roller. Commonly, two load roller assemblies are positioned side by side to texture the front and back surfaces simultaneously. To facilitate the process, the rigid-disk substrate is often rotated against the tape/roller system at high rate of speed relative to the tape.

Numerous variations to this basic process exist. For instance, often a liquid is supplied at the tape/disk interface to lubricate and/or cool the disk surface during the cutting process. Cross-hatching of the grooves may be accomplished by mechanically oscillating the roller across the radius of the disk. e.g., from the inside diameter to the outside diameter. As is appreciated by practitioners in the art, the quality of the microscopic grooves is extremely dependent on a great many process variables which have remained relatively uncontrolled in prior approaches.

After the rigid-disk surface has been textured, a thin magnetic film is applied to the surface of the disk. The thin magnetic film comprises the actual recording media. Most magnetic films are nickel-cobalt alloys which are deposited by either electrical plating, chemical plating, evaporation or sputtering. The thickness of these films vary, but typically they range anywhere from 2 to 3 microinches.

Following the deposition of the magnetic media material, a protective overcoating (typically some sort of carbon compound) is sputtered onto the surface of the substrate. The overcoating is applied after the magnetic layer to provide abrasion resistance from the recording head. Buffing of the protective overcoat completes the processing of the magnetic rigid disk.

There are a number of drawbacks associated with prior art texturing machines. For instance, it is not uncommon for the disk to become slightly displaced from its normal stationary plane of rotation. When this happens, the force applied to the workpiece surface (via the load roller) may change radically. Changes in applied force result in aberrations in the quality and uniformity of the grooves. Prior art force management systems have been unable to adequately compensate for disk displacement.

Furthermore, because the circumference of the disk is greater at its outside diameter than at its inside diameter, the uniformity of the grooves across the disk surface is subject to variation. In other words, more cutting occurs at the inside diameter relative to the outside diameter. To compensate for this circumferential difference, a greater force must be generally applied to the outside diameter of the disk than that which is applied to the inside diameter. In other words, the load bearing roller must be skewed to precisely distribute the applied force in a prescribed manner across the width of the abrasive tape. Providing a precisely controlled skew force has proven problematic in prior art texturing machines.

Yet another problem associated with prior art systems involves how the abrasive tape initially contacts the disk surface. In the past, the load rollers have usually been forced against the surface of the disk using hydraulic and/or pneumatic means. This technique generally results in deep grooves, commonly referred to as "skidmarks", being imprinted into the disk surface upon initial contact of the load rollers. Obviously, the presence of skidmarks adversely affects the overall surface quality of the rigid storage media.

As will be seen, the present invention provides an apparatus for texturing the surface of a digital magnetic recording disk in which the force applied to the surface of the disk manages to be independent of disk displacement or position. The present invention insures that both surfaces of the disk (front and back) are subject to the same measure of force—including an identical distribution of applied force across the radius of the rotating disk (i.e., identical skews). In addition, the apparatus of the present invention provides a system in which the abrasive tape is brought to bear upon the disk surface with negligible initial force, thereby eliminating the skidmarks which are characteristic of many prior art systems.

SUMMARY OF THE INVENTION

An apparatus for texturing the front and back surfaces of a rigid-disk substrate used in magnetic recording systems is disclosed. In one embodiment, the apparatus comprises a means for rotating the substrate in a stationary plane and first and second mechanical assemblies. Each of the assemblies includes an abrasive tape, a load-bearing roller member, and a means for moving said tape over the roller member. Each assembly also comprises a means for applying a direct force component to each of the roller members to press the tape against the substrate surface. The force application means also is capable of delivering a skew force to each of the roller members to distribute the direct force across the width of the abrasive tape surface.

The invented apparatus also includes a force coupling network for mechanically coupling each of the assemblies together in such a way that the direct and skew forces applied to the front surface of the substrate are identical to the direct and skew forces applied to the back surface of the substrate. Altogether, the present invention functions in such a manner that the total applied force is independent of the substrate's position or displacement.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

FIG. 2 also shows the position of the rigid-disk substrate relative to the load roller assemblies.

DESCRIPTION OF THE PREFERRED EMBODIMENT(S)

The present invention covers an apparatus for texturing the surfaces of a rigid-disk substrate utilized in digital magnetic recording systems. In the following description, numerous specific details are set forth such as dimensions, materials, etc., in order to provide a thorough understanding of the present invention. It will be obvious, however, to one skilled in the art that these specific details may not be required to practice the present invention. In other instances, well-known mechanical elements such as springs, gauges, bearings, etc., have not been described in detail in order not to unnecessarily obscure the present invention.

Figure 1:
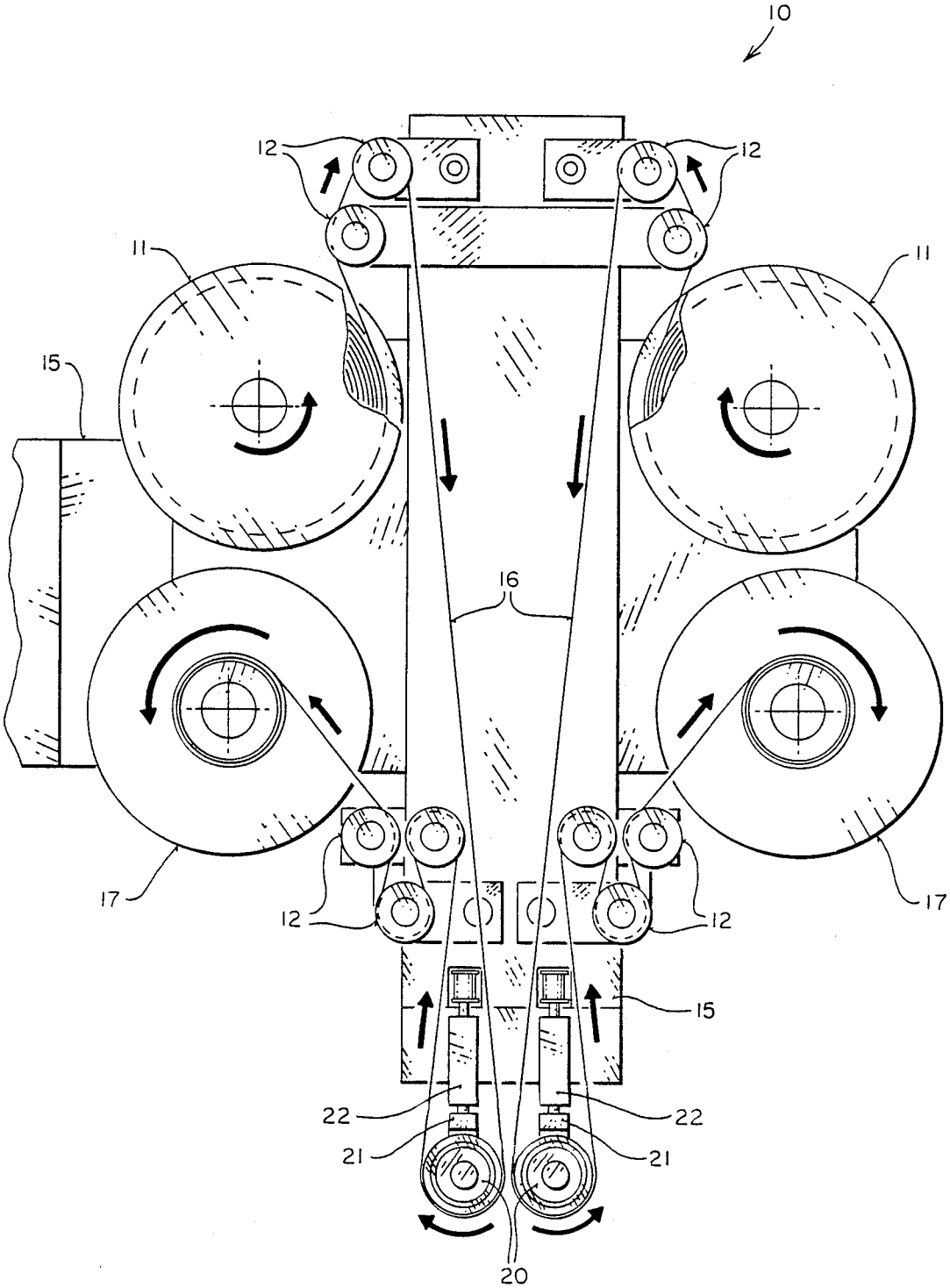
FIG. 1 is a front view of the tape transport mechanism of the currently preferred embodiment of the present invention.

Referring to FIG. 1, a front view of the tape transport mechanism of the electro-mechanical texturing apparatus of the present invention is shown. Texturing apparatus 10 includes a symmetrical pair of assemblies whose function is to act in concert to simultaneously texture the front and back surfaces of a rotating rigid-disk substrate. The substrate, also frequently referred to as the workpiece, is normally attached to a spindle and rotated at a relatively high velocity. An abrasive tape is then forcibly pressed onto the front and back surfaces of the workpiece by the load roller assemblies to cut microscopic grooves into the disk's surfaces.

Each of the assemblies includes an abrasive tape 16 which comprises aluminum oxide, or some other similar abrasive, embedded in a binder system which is then coated onto a flexible mylar backing. Tape 16 originally is wound around supply reel 11. From there it is threaded through a plurality of tape guides 12 and around load roller 20—eventually to be gathered up on take-up reel 17. Each of the take-up reels 17 are mounted to a tape motor which winds up tape 16 at a constant speed. In the preferred embodiment, the motor (not shown in FIG. 1) typically turns at a rate such that approximately seven inches of tape are passed over load roller 20 per minute. During texturing of the workpiece, a portion of tape 16—which may be hundreds of feet in length—will be transferred from supply reel 11 to take-up reel 17. Tape guides 12 and a brake attached to each of the supply reels 11 (brakes also not shown in FIG. 1) provide proper tensioning of tape 16 during the texturing process. Note that the arrows in FIG. 1 denote the direction that the tape is travelling during processing.

Each of the load rollers of FIG. 1 is mounted to a bracket 21. Preferably, bracket 21 is L-shaped with one end of bracket 21 attaching to the end of cylindrically-shaped load roller 20. In other embodiments it is appreciated that other types of brackets may be used without departing from the spirit and scope of the present invention. As shown in FIG. 1, bracket 21 is attached to pivot block 22, which itself is attached to chassis 15. The details of the coupling between elements 20, 21, 22 and 15 will be described shortly.

Figure 2:
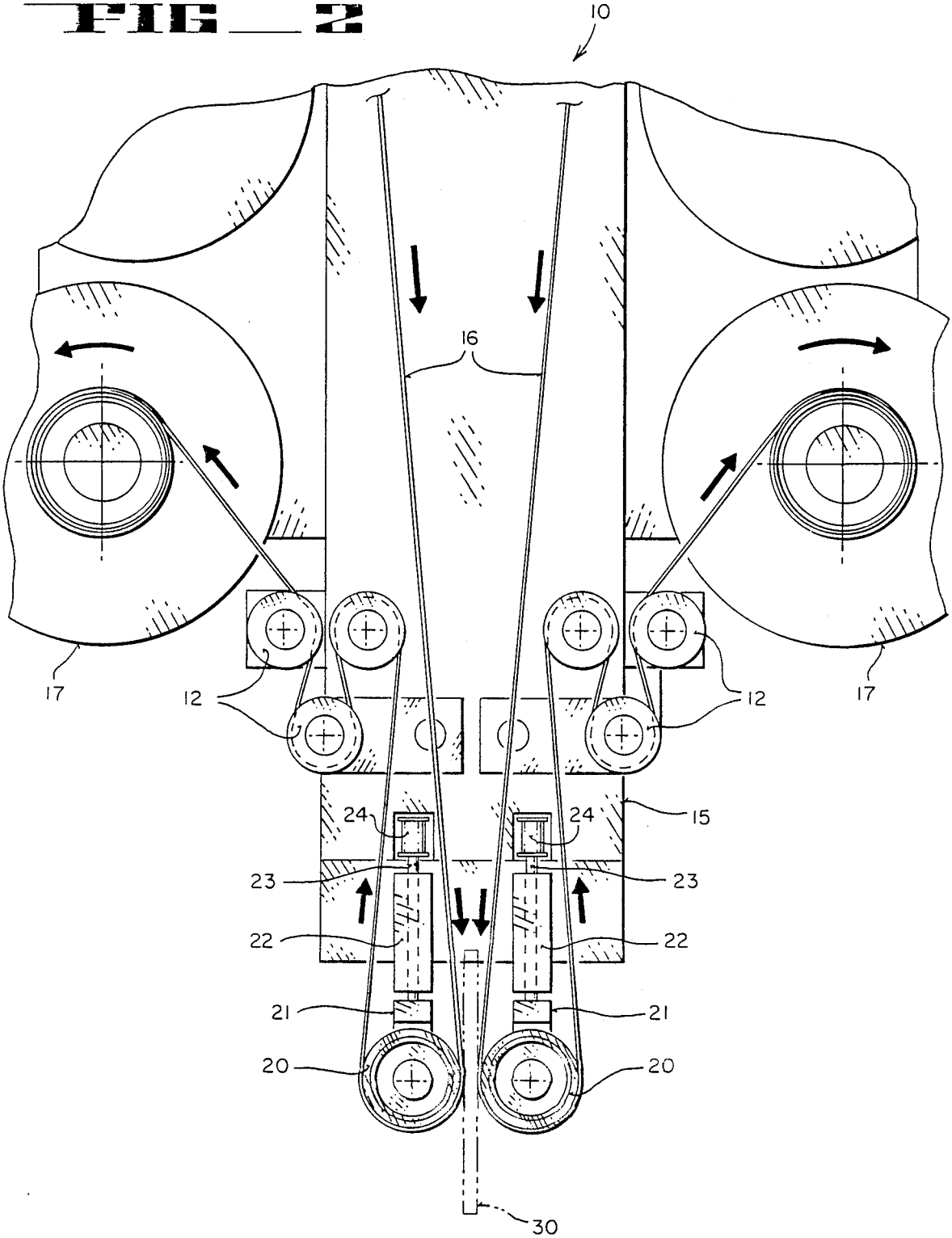
FIG. 2 is an expanded view of a portion of FIG. 1.

An expanded view of the load roller assemblies of texturing apparatus 10 is illustrated in FIG. 2. In addition to showing load rollers 20, L-shaped bracket 21 and pivot block 22, FIG. 2 also depicts the location of substrate 30 during the texturing process. During processing, load rollers 20 press tape 16 against the front and back surfaces of the rotating disk substrate.

Additionally, FIG. 2 shows a transverse rod 23 which is used to mount L-shaped bracket 21 to pivot block 22. Transverse rod 23 is rigidly coupled to bracket 21 at one end so that any rotational moment applied to rod 23 is transferred directly to bracket 21. The other end of rod 23 passes through block 22 and terminates at drum 24. When assembled, transverse rod 23 rotates freely on a bearing system provided inside pivot block 22. As will become more apparent later, rod 23 is utilized to apply a skew moment to load roller 20.

Figure 3:
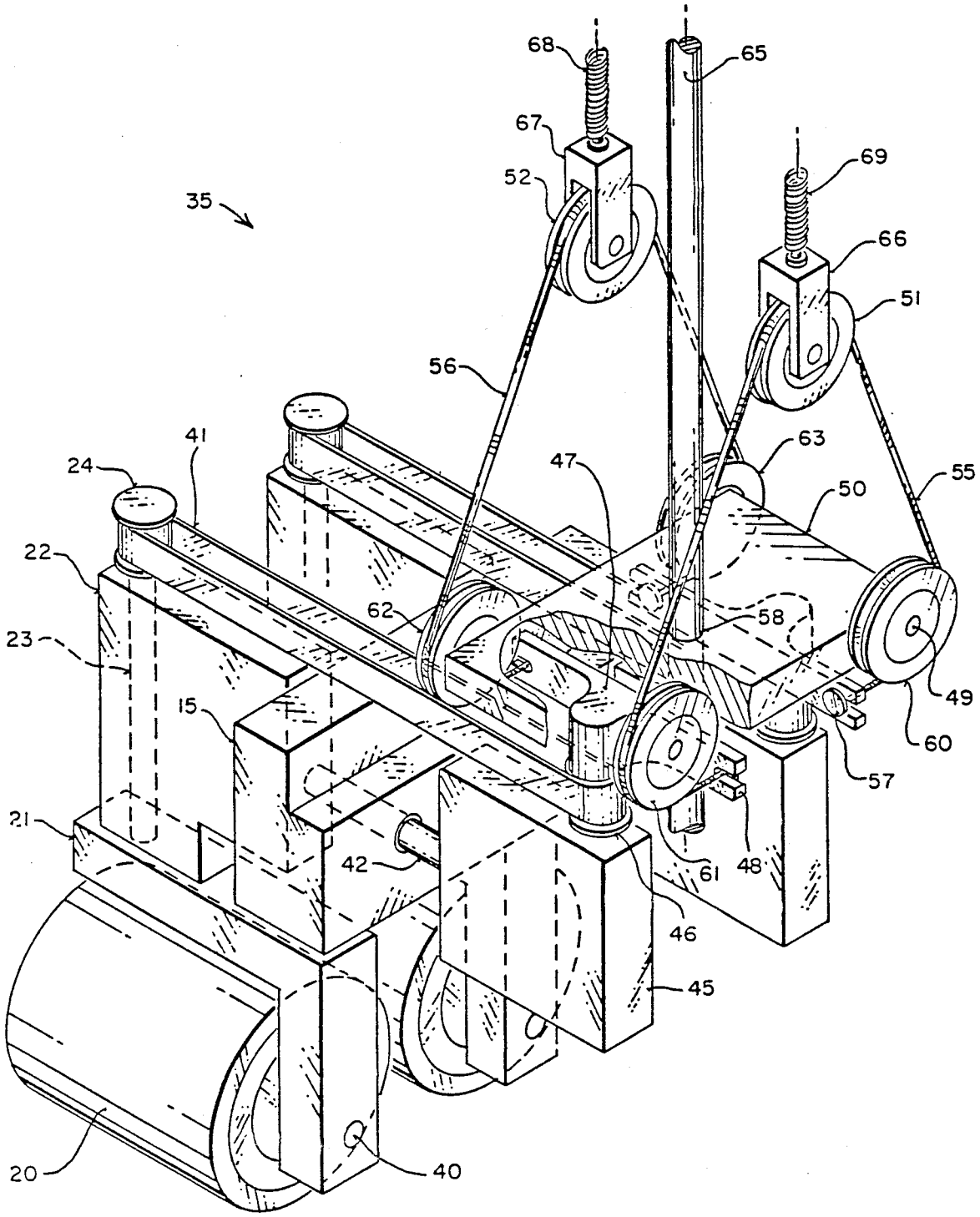
FIG. 3 illustrates the load roller assemblies of the presently preferred embodiment and also the coupling network which mechanically couples each of the assemblies to each other to insure that identical forces are applied to both surfaces of the rigid-disk substrate.

Referring to FIG. 3, a section 35 of texturing apparatus 10 is shown. Section 35 includes a pair of apposed mechanical assemblies employed to position the load rollers in close proximity to the front and back surfaces of the substrate material. Section 35 also includes a pulley mounting platform 50 mounted to chassis 15 and a pulley system which provides the means for applying and controlling the various force components applied to the load rollers.

Each of the load rollers 20 comprises a cylindrically-shaped drum having rubber, or other similiar material, covering its outer surface. In the preferred embodiment, rubber is used to a thickness of approximately three-eighths of an inch. When the load rollers are forcibly pressed against the substrate surface the rubber compresses to form a flat contact region called a nip. The extent to which the load roller is compressed against the disk (i.e., the length of the nip) is generally less than one hundred thousandth of an inch in length.

The load rollers are mounted to bracket 21 along an axle 40. Axle 40 is rigidly attached to bracket 21 and extends through the center of load roller 20. A bearing system within load roller 20 permits free rotational movement of the load roller around axle 40. This allows the load roller to rotate with the speed of the tape during texturing.

Bracket 21 is shown in FIG. 3 as a rigid L-shaped member. However bracket 21 may assume any shape which is feasible for mounting load roller 20 in a position such that the outer surface of roller 20 is approximately parallel to the surface of the workpiece. Bracket 21 further includes a vertical section which fixedly attaches to axle 40, and a horizontal section which extends over the top of load roller 20. Mounted to the top section of L-shaped bracket 21 is transverse shaft 23.

As previously described, transverse shaft 23 is rigidly attached at one end to bracket 21 while the other end extends through the interior of pivot block 22 where it eventually is terminated by drum 24. Drum 24 comprises an ordinary cylindrically-shaped metal drum around which steel band 41 is wrapped. Drum 24 may include grooves or flanges for securely retaining the position of band 41 around drum 24. In the preferred embodiment, a screw is threaded through band 41 and into drum 24 assure tight coupling between band 41 and drum 24.

Drum 24 is also rigidly attached to transverse shaft 23 so that any rotational force applied to drum 24 is directly translated to shaft 23. The bearing system within pivot block 22 allows movement of shaft 22 only in a rotational direction. Because shaft 23 is rigidly attached to bracket 21 and drum 24, all three of these elements (i.e., bracket 21, shaft 23 and drum 24) act in unison. In other words, any rotational moment applied to drum 24 will be transferred directly to L-bracket 21, and therefore to load roller 20.

FIG. 3 also depicts front pivot block 22 being rigidly coupled to longitudinal shaft 42. Longitudinal shaft 42, which extends through a portion of chassis 15, is also rigidly coupled to rear pivot block 45. Shaft 42 is on a bearing system within chassis 15 which permits free rotational movement. This means that a rotational moment applied to rear pivot block 45 is transferred directly to front pivot block 22. Hence, a rotational moment applied to rear pivot block 45 about shaft 42 ultimately produces movement in load roller 20 in a direction either towards or away from the surface of the rigid-disk substrate.

It should be understood that any number of materials or shapes may comprise blocks 22, 45, chassis 15 and bracket 21. For example, plastics, woods or metals manufactured in various shapes would be sufficient. All that is required is that the material have properties of resiliency and density sufficient to withstand the various force components applied. Preferably, bracket 21, blocks 22 and 45, and chassis 15 comprise aluminum which has been machined into rectilinear shapes.

Figure 4:
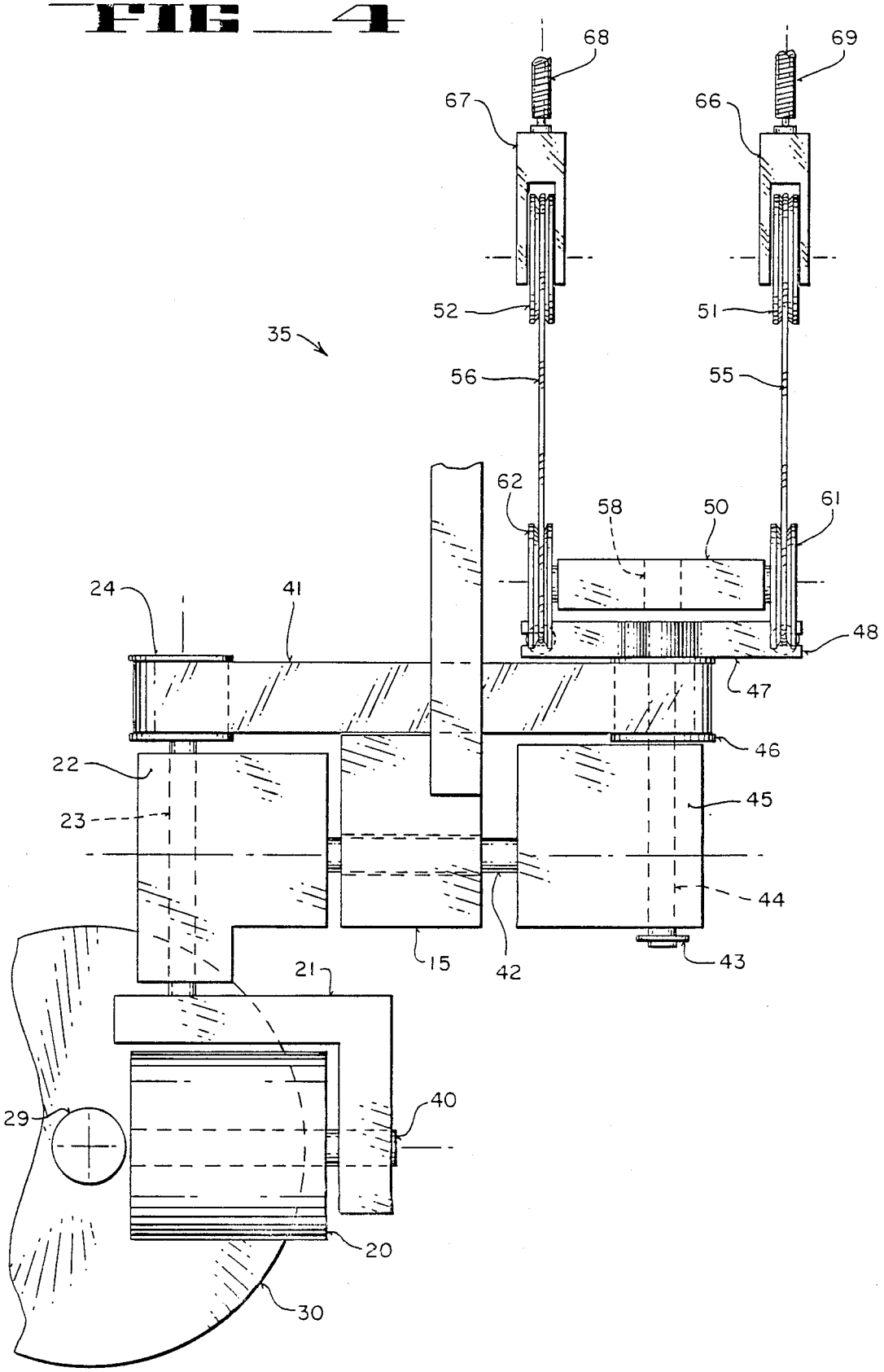
FIG. 4 shows a side view of the assembly illustrated in FIG. 3.

Rotatably mounted within rear pivot block 45 is a second transverse shaft 44 (see FIG. 4). Similar to shaft 23 within block 22, shaft 44 is also on a bearing system within block 45. This permits free rotational movement of shaft 44 within block 45. Attached to the top of shaft 44 and positioned above block 45 is drum 46. Drum 46 is basically identical to drum 24 in every respect. Second transverse shaft 44 is secured within block 45 by a locking device 43 (see FIG. 4).

Steel band 41 is shown in FIG. 3 tauntly stretched around each of the drums 24 and 46. The purpose of band 41 is to transfer any rotational moment applied to shaft 44, directly to shaft 23. For example, if band 41 is correctly coupled to drums 24 and 46, then as shaft 44 is rotated in a clockwise direction shaft 23 will be rotated in the same direction by the same distance.

It should be recognized that materials other than steel may comprise band 41. Other materials might prove acceptable as long as they fulfill the function of direct transfer of rotational movement from shaft 44 to shaft 23. In other words, the material which makes up band 41 must be strong enough to withstand the forces involved and to avoid slippage with drums 46 and 24. The material should also be non-elastic since elasticity in band 41 might reduce the mechanical coupling strength between shaft 44 and shaft 23.

Taken as a whole, each of the assemblies described above are positioned so that load rollers 20 are in close proximity (approximately 0.030 inches in the preferred embodiment) to the rigid-disk substrate surface in the absence of a force being applied to either of the pivot blocks 22 and 45, or to shafts 44 and 23.

The force application and management system comprises a mechanical coupling network which includes mounting platform 50, pulleys 60–63, wing members 47, wire cables 55 and 56, upper pulleys 51 and 52 and springs 68 and 69. Pulley mounting platform 50 is a rectangular tray which provides mounting locations on axles 49 for each of the pulley wheels 60–63. Pulleys 60–63 are each located near one of the four corners of pulley mounting platform 50 where they rotate freely about their axis.

Pulley mounting platform 50 is attached to chassis 15 such that it rests just above wing members 47. Each wing member 47 is an elongated bar which is fixedly mounted at its center to the top of drum 46. Any rotational movement of wing member 47 is therefore coupled directly to drum 46. At the ends of each wing member are notches 48 that are used for attaching the ends of cables 55 and 56.

Cables 55 and 56 are ordinary steel cables having a diameter of about fifty thousandths of an inch. Each is threaded from one notch at the end of one wing member, around one wheel pulley, through an upper pulley, around another wheel pulley, and finally secured at the end of the opposite wing member. Cable 55 is secured at the ends of the wing members by a head 57. By way of example, FIG. 3 shows cable 55 as being threadably guided by wheel pulleys 61 and 60 and by upper pulley 51. Likewise, cable 56 is threadably guided by wheel pulleys 62 and 63 and also upper pulley 52. Upper pulleys 51 and 52 are mounted to brackets 66 and 67, respectively.

Attached to the tops of each of the brackets 66 and 67 are springs 69 and 68, respectively. Each spring is coupled to a separate stepper motor which is employed to raise and lower the pulley. Each stepper motor is controlled separately so that the upper pulleys may either be raised independently or in unison. The stepper motor mechanism will be described in more detail later.

Two distinct components of force may be applied to the load rollers, and consequently to the rigid-disk surfaces, according to the mechanical coupling network shown in FIG. 3. Consider the case in which both upper pulleys 51 and 52 are raised in unison by equal amounts. Because each wheel pulley is attached at a fixed location on mounting platform 50, raising pulleys 51 and 52 will cause wing members 47 to move away from each other. (Actually, wing members 47 rotate away from each other about the axis formed by shaft 42). Put another way, each of the end portions 48 will be drawn towards their associated wheel pulleys.

As long as the displacement of upper pulleys 51 and 52 is equal, no torque will be applied to wing member 57. This means that there will be no rotational moment delivered to shaft 44 and therefore no rotational moment applied to shaft 23, or L-bracket 21 for that matter. The only component of force that will be applied to the assemblies is a foce which acts to rotate pivot blocks 45 and 22 about shaft 42. This force may be referred to as a direct force.

Due to the coupling between pivot blocks 45, 22 and load roller 20, as described above, the direct force component acts to press the outer surface of load roller 20 against the surface of the rigid-disk substrate. The direction of the direct force will be inwardly perpendicular to the stationary plane formed by the substrate surface. The magnitude of the direct force at the tape/substrate interface is a function of the force applied to wing member 47 and the ratio of the distances between wing member 47, shaft 42 and axis 40. In the preferred embodiment of the present invention, the magnitude of the direct force component is between 0–6 pounds of pressure.

A skew force is applied to load rollers 20 raising one of the pulleys either higher or lower than its counterpart. By way of example, as upper pulley 51 is raised higher than upper pulley 52 a rotational force or torque is delivered to each of the wing members 47. This rotational force is transferred to shaft 44 and, due to the mechanical coupling provided by band 41, to transverse shaft 23. Load roller 20 is rotated accordingly. This action is shown in FIG. 5*b*. Thus, a rotational skew force applied to wing members 47 results in a skew of load rollers 20. This skew force also acts to distribute the direct force component unequally along the width of tape 16.

Referring again specifically to FIG. 3, a loading rod 65 is shown passing through a opening 58 in the center of pulley mounting platform 50. At its upper end rod 65 is coupled to the stepper motor assembly, and at its lower end to a specialized guide member which permits loading and unloading of the load rollers from the substrate surface with zero, or negligible, initial force. This aspect of the present invention will be discussed in more detail later.

With reference to FIG. 4, a side view of section 35 (originally presented in FIG. 3) is provided. In addition to each of the elements previously described above, FIG. 4 also illustrates the relationship of load roller 20 to the rigid disk substrate 30. As can be seen, the length of load roller 20 is slightly greater than the radius of substrate 30. Practically, the apparatus of the present invention may accommodate numerous sizes of rigid-disks ranging from 65 millimeters up to 130 millimeters in diameter. Because of the precise control force achieved by the present invention, wider tape widths and load rollers may be accommodated—leading to greater efficiencies—as compared to prior art machines. As mentioned, substrate 30 is attached to spindle 29. Spindle 29, in turn, is coupled to a motor shaft which is used to rotate substrate 30 at a high velocity. (Note that in FIG. 4, loadilng rod 65 has been omitted for purposes of clarity).

Figure 5A:
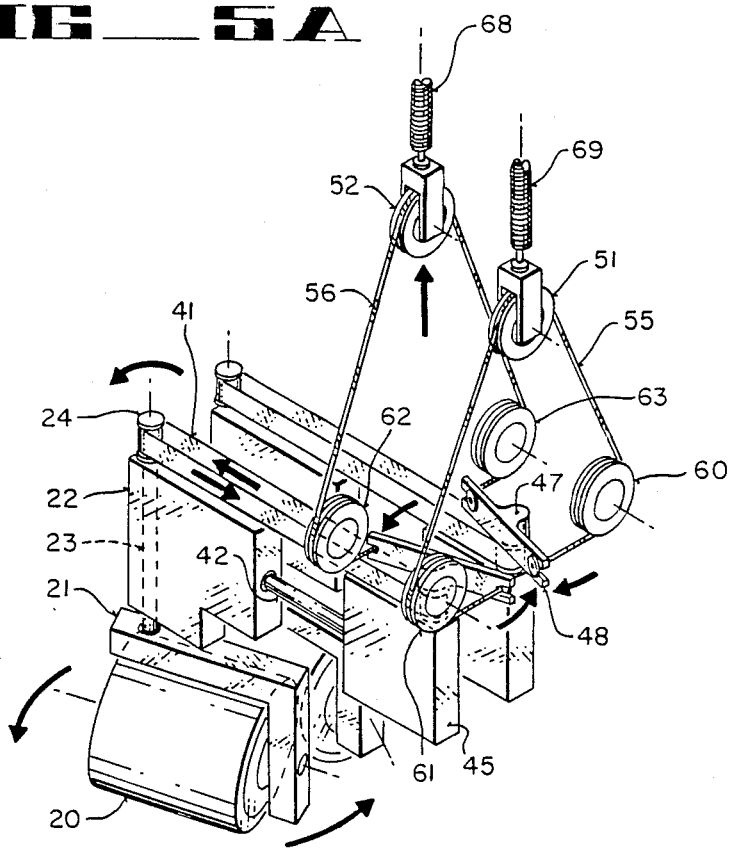
FIG. 5*a* illustrate how a skew force may be applied to the load rollers in one direction by raising one of the upper pulleys of the coupling network relative to the other.
Figure 5B:
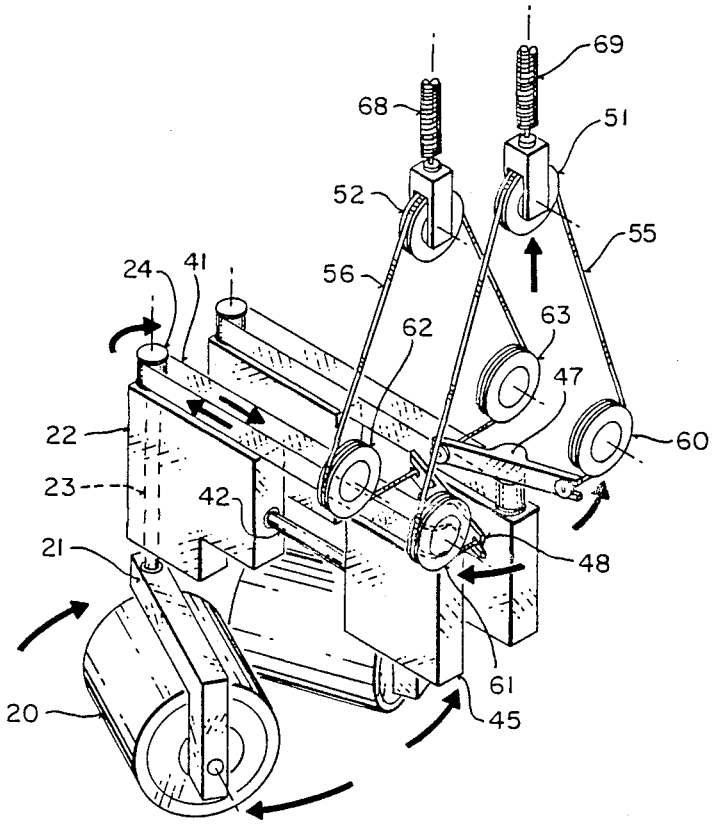
FIG. 5*b* illustrates how a skew force may be applied to the load rollers in the direction opposite to that shown in FIG. 5*a*.

Referring now to FIGS. 5*a* and 5*b*, two illustrations of how a rotational moment may be applied to load rollers 20 are given. In FIG. 5*a*, upper pulley 52 is raised relative to upper pulley 51. This pulls cable 56 so that the front ends of wing members 47 are drawn towards wheel pulleys 62 and 63. In comparison, the rear ends of wing members 47 are drawn toward each other. Restated another way, the rear ends of wing members 47 are pulled away from their associated wheel pulleys 61 and 60. This rotational movement of wing members 47 is transferred directly to drum 46 and shaft 44. Because of the nature of the described mechanical coupling, rotation of drum 46 causes band 41, drum 24, shaft 23, bracket 21 and ultimately load roller 20 to move in the direction shown.

Because more abrasive wear takes place near the inside diameter of substrate 30 as compared to the outside diameter (due to the circumferential differences involved) it is often desired to skew the total force applied to load roller 20 during the texturing process. Usually, this mandates that greater force be applied to the outside diameter of the disk—which contains much more area—than to the inside diameter. To bring about this condition, upper pulley 52 is raised higher than its counterpart pulley 51. This distributes the total force applied to the workpiece so that an evenly textured surface—from the inside diameter to the outside diameter—may be produced. This type of skew is shown in FIG. 5*a*.

Note that the movements of load rollers 20 in FIGS. 5*a* and 5*b* are exaggerated for illustration purposes. In reality, the amount of skew applied to the load rollers during processing is generally on the order of plus or minus one degree. Note also in FIGS. 5*a* and 5*b* that as long as only a skew force is applied in the loaded position, pivot blocks 22 and 45 remain stationary. But if a skew force is applied in conjunction with a direct force component, then pivot blocks 22 and 45 will rotate, or pivot, accordingly.

A key aspect of the present invention is how each of the mechanical assemblies are functionally integrated with each other through the mechanical coupling network described above. Because the coupling network applies the force components to the repective load roller assembies equally, this guarantees that each side of the substrate is subject to identical forces. The total applied force (represented by the sum of the direct force and the skew force components) is guaranteed to be identical on each side of the workpiece. Also, the distribution of applied force across the length of the abrasive tape contacting the substrate is also guaranteed to be identical on both the front and back surfaces of the rigid-disk. Moreover, the forces applied to each side of the workpiece remains identical independent of any displacement or change in position of the substrate. For example, if the substrate were to move out of its normal plane of rotation—either toward or away from one of the load rollers—the total applied force on the front and back surfaces would remain equally and constant. Since both mechanical load roller assemblies are coupled together by the described pulley system, movement on one side of the disk is mirrored on the other side. Thus, the electro-mechanical system described is capable of delivering precise and equal force to each side of the workpiece independent of the displacement and position of the workpiece. For the same reasons, the distribution of force applied to both sides of the workpiece (i.e., skew) is also independent of displacement and position.

Figure 7:
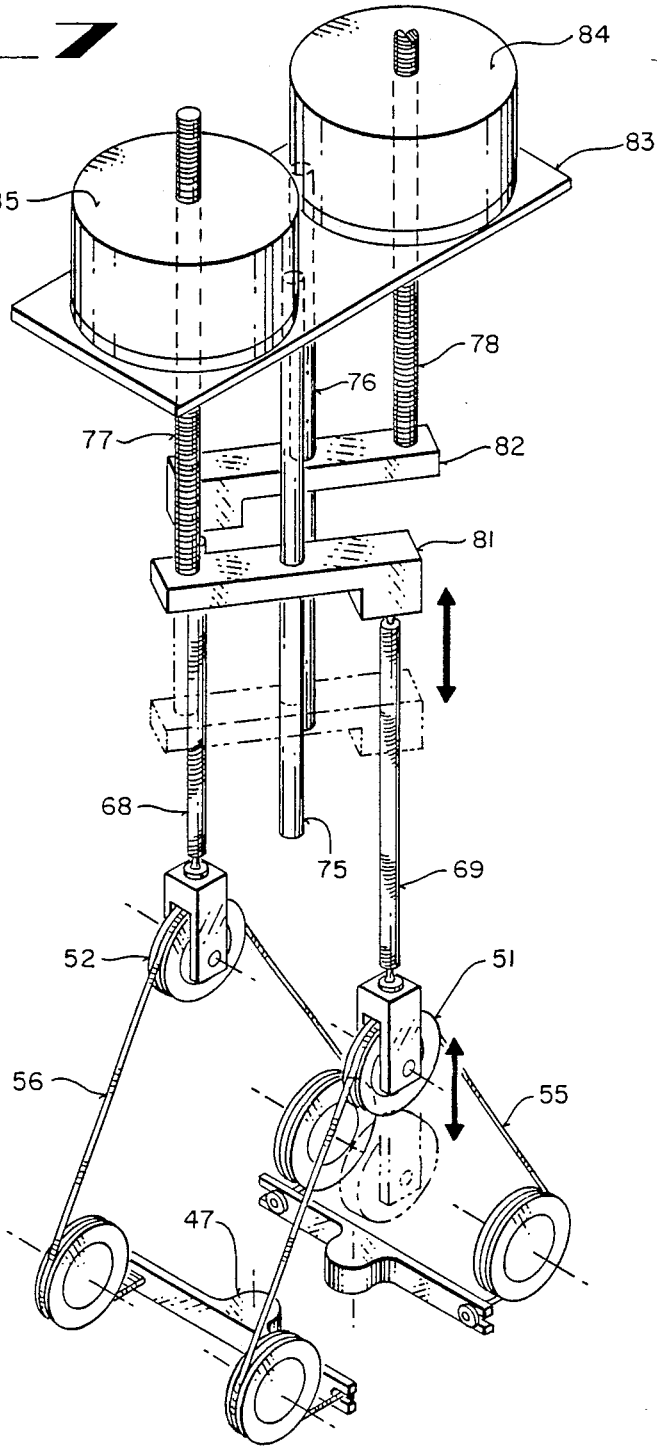
FIG. 7 illustrates the mechanism by which the upper pulleys of the coupling network are raised or lowered.

With reference now to FIG. 7, the stepper motor system which provides a means for raising and lowering pulleys 51 and 52 is shown. The system comprises stepper motors 84 and 85 which are mounted on platform 83. Platform 83 is attached to chassis 15 of the texturing apparatus (not shown in FIG. 7). Also included are threaded shafts 77 and 78 and slide guide rails 75 and 76. Slide guide rails 75 and 76 are fixedly attached to the bottom of mounting plate 83. These rods act as guides to bracket members 81 and 82 which slide up and bottom across members 75 and 76 in accodance with the operation of stepper motors 85 and 84, respectively. Bracket members 81 and 82 in turn are coupled to springs 69 and 68, respectively.

Raising and lowering of the upper pulleys 51 and 52 is accomplished by raising and lowering threaded rods 77 and 78 through motors 85 and 84. As is well-known, when the stepper motor is electrically activated the threaded rod is either raised or lowered (depending on the polarity of the applied voltage) through the center of the stepper motor housing. Since each of the rods 77 and 78 are fixedly attached to bracket members 81 and 82, respectively, raising and lowering of the rods results in a corresponding movement in the upper pulleys. This is depicted in FIG. 7 by the arrows and the dashed lines showing two different positions for bracket member 81 and upper pulley 51. Understand that the movements shown in FIG. 7 (and also in FIGS. 5*a* and 5*b*) are exaggerated for purposes of illustration. Actually, the upper pulleys only move to load the disk. Beyond that, the upper pulleys remain by and large stationary, with springs 68 and 69 stretching to deliver the various forces.

The force exerted on each of the upper pulleys (and therefore the force which is transferred to the respective load roller) is a function of the spring displacement and the spring's force constant. Thus, the applied force is given the equation $F=kX$; where F represents the force, k represents the force constant of the spring and X represents the displacement. If the force constant of the spring is known, the applied force at the tape/substrate interface may be estimated by approximating the distance traversed by each of the threaded rods.

Figure 6:
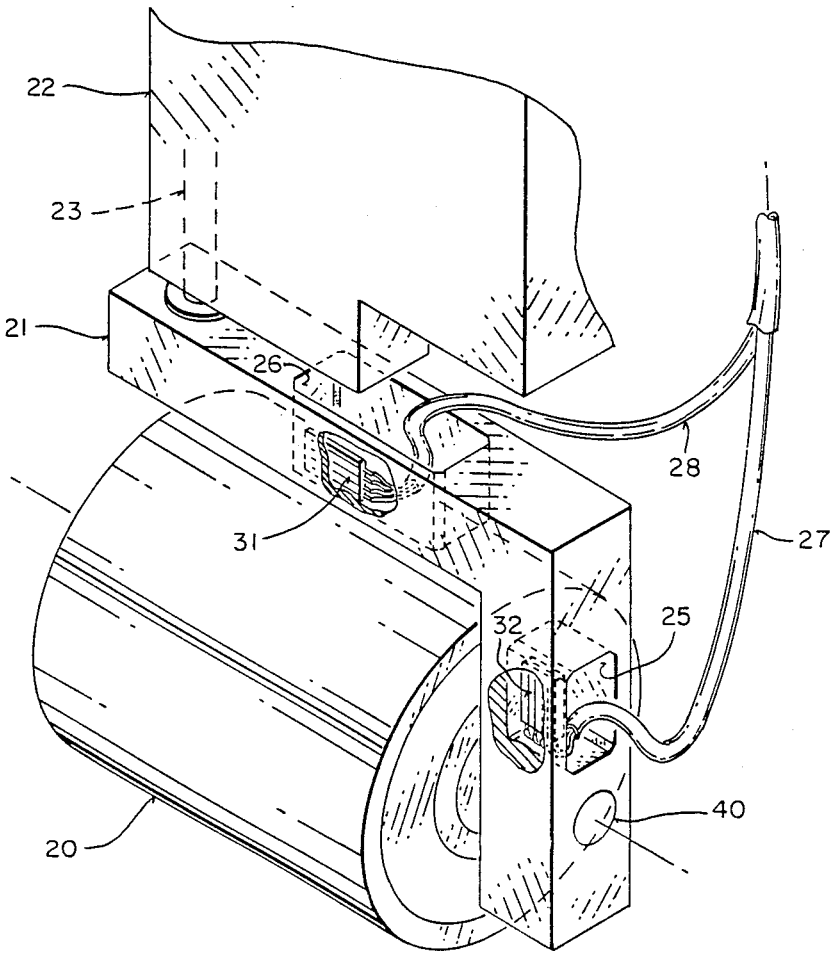
FIG. 6 illustrates how strain gauges may be attached to the load roller bracket to measure the forces applied to the abrasive tape.

FIG. 6 shows a way of measuring the direct force and the skew force components applied to the load roller, and therefore to the substrate surface, in a more precise manner. In FIG. 6, bracket 21 is shown having cavities 26 and 25 along the top and side surfaces, respectively, of the L-shaped bracket member. Attached to the inner side surfaces of cavities 26 and 25 are strain gauges 31 and 32, respectively. Each gauge comprises a plurality of thin wires which are electrically sensitive to changes in tension of stress in the respective portions of mounting bracket 21. The amount of tension of stress detected in each of the sections of bracket 21 are an indication of the amount of force applied to the workpiece through load roller 20.

For example, as transverse shaft 23 is rotated, tension develops in the upper, horizontal portion of L-bracket 21. This corresponds to a skew force being applied to the surface of the substrate. The skew force is detected by strain gauge 31 which sends a electrical signal along cable 28 to a meter or other similar measurement or control apparatus.

In like manner, strain gauge 32 mounted along the vertical portion of bracket 21 is useful in measuring the direct force component applied in a direction perpendicular to the plane of the ridid-disk substrate surface. Cable 27 transmits the electrical signal produced by strain gauge 32 to the measurement or control instrumentation. Ideally, a microprocessor is used to allow the user to precisely program each force component.

It is appreciated that the preferred placement of gauges 31 and 32 along the horizontal and vertical portions of bracket 21 permits measurement of the applied forces virtually at the point of use (i.e., at the disk/tape interface). That is, having the gauges situated on L-bracket 21 means there is little to interfere with the fundamental measurement. If gauges 31 and 32 were, for instance, located back in pivot block 45 or wing member 48, then uncertainty would be introduced due to the mechanical drag force associated with the in between mechanical elements. Also realize that since the direct and skew force components are identical on both sides of the substrate surface only one pair of strain gauges need be employed on one of the mounting brackets 21.

Figure 8:
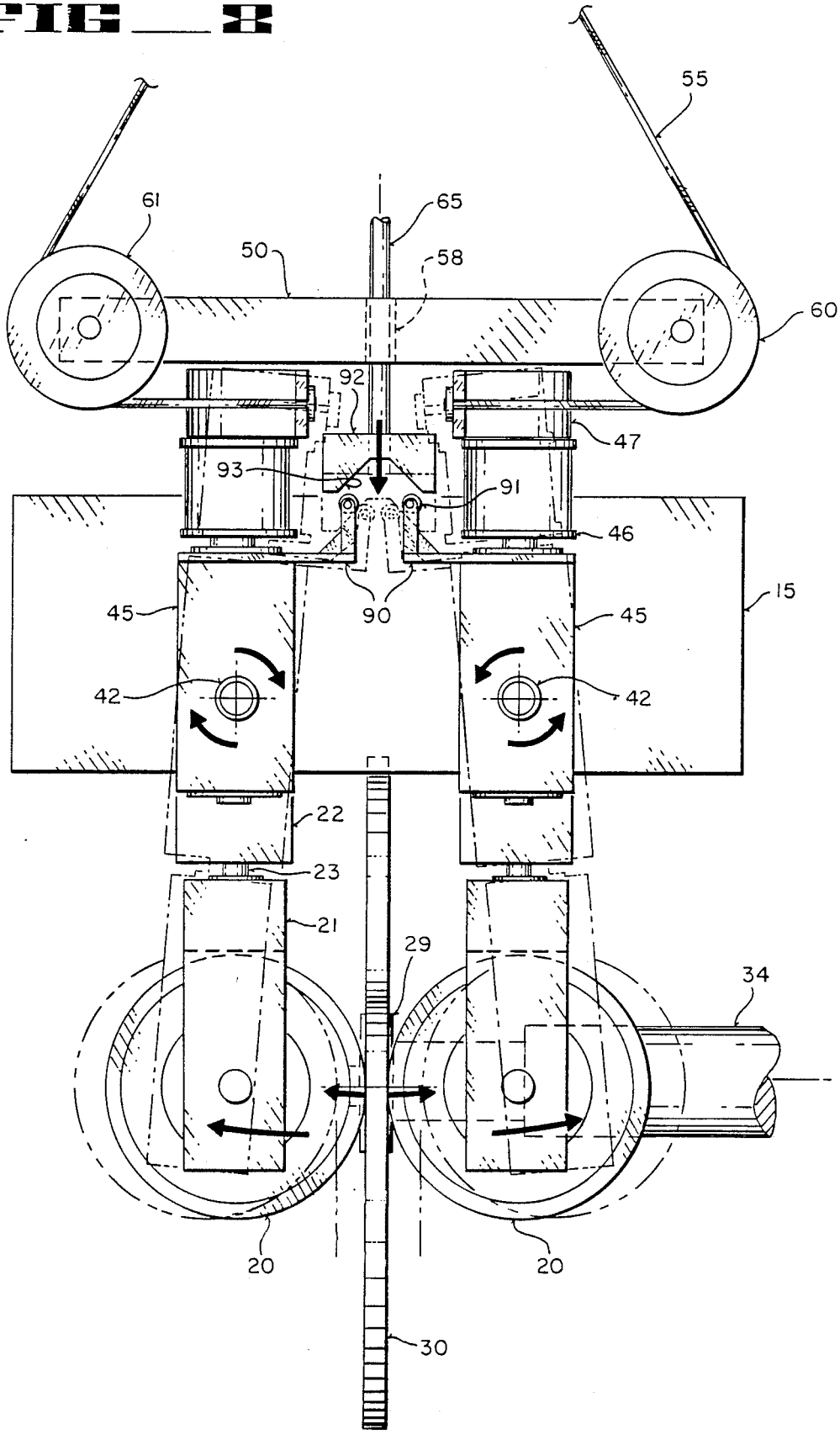
FIGS. 8 and 9 illustrate the mechanism used for bringing the load rollers to bear upon the rotating rigid-disk substrate surface with negligible initial force.
Figure 9:
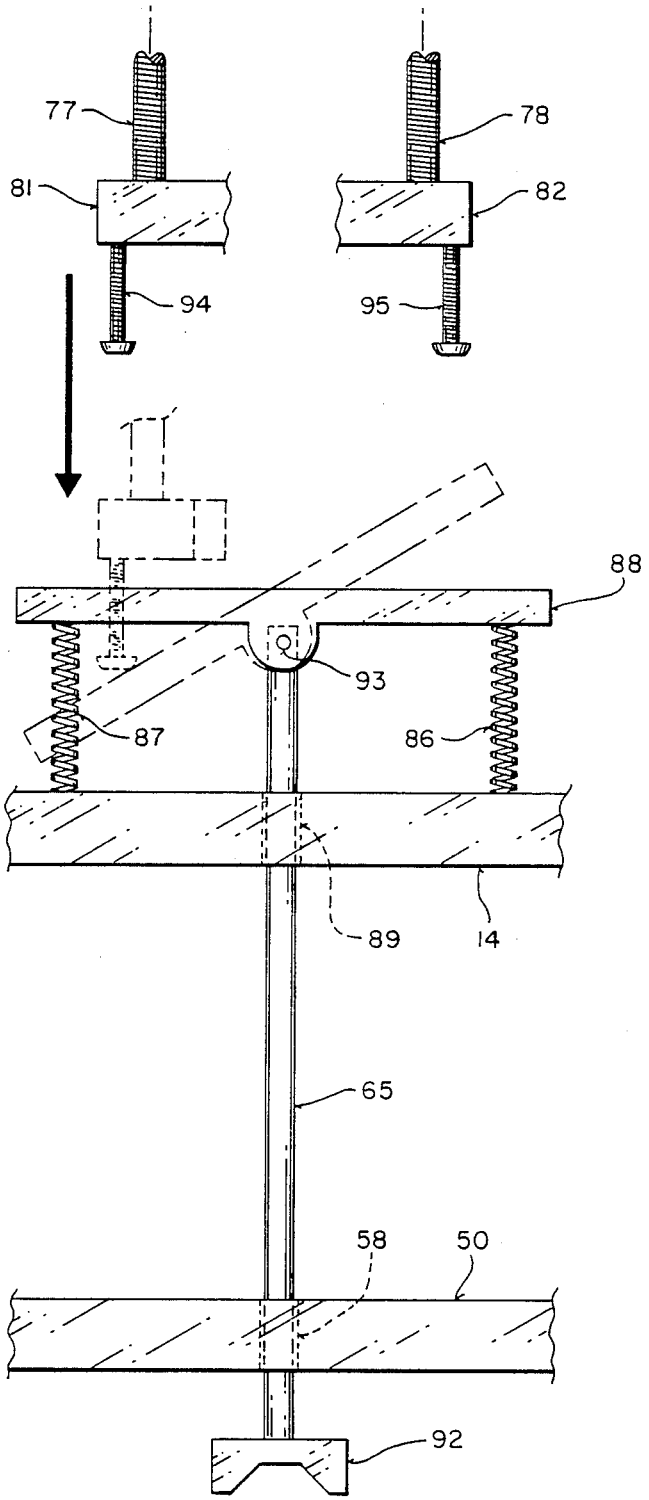

Referring now to FIGS. 8 and 9, a rear view of the texturing apparatus, which includes a mechanism for assuring that rollers 20 load and unload from the surface of the substrate with negligible force, is shown. At its bottom end, the mechanism comprises rod 65, V-shaped block member 92, wheels 91 and perpendicular bracket members 90. At its upper end (to be described in more detail below), rod 65 is coupled to members 81 and 82 such that rod 65 is raised or lowered whenever stepper motors 84 and 85 raise or lower members 81 and 82 in unison. V-shaped block member 92 is firmly attached to the bottom end of rod 65.

As load rod 65 is lowered (for example during unloading of the load rollers from the rigid disk surface), the flat surfaces 93 of block member 92 contact wheels 91 of bracket members 90. Note that each of the bracket members 90 is fixedly mounted to the top of pivot blocks 45. After contacting rollers 91, further lowering of rod 65 forces rollers 91 toward the center of block 92. This is depicted in FIG. 8 by the dashed lines representations.

Because of the rigid bond between members 90 and pivot block 45, movement of rollers 91 along surface 93 forces pivot block 45 to rotate about shaft 42. This rotational movement is in a direction which releases load rollers 20 from the surface of substrate 30. It should be understood, of course, that block member 92 is positioned so that load rollers 20 are unloaded from the surface of substrate 30 at the same instant that force is being released (i.e., by lowering of upper pulleys 51 and 52) from the corresponding mechnaical assemblies.

As rod 65 is raised, rollers 91 slide down along incline 93 until force is gradually applied to the surfaces of substrate 30. In this way, load rollers 20 may be loaded and unloaded from the workpiece surface with negligible initial force. As previously mentioned, rod 65 slides through opening 58 in pulley mounting platform 50. In the preferred embodiment, a bushing is included in opening 58 to minimize side-to-side movement of rod 65. Also shown in FIG. 8 is spindle rod 34 which extends from a motor (not shown) for rotation of substrate 30. Substrate 30 is held on spindle 34 with an expanding collet 29.

With specific reference to FIG. 9, it can be seen that the upper portion of rod 65 is hinged to a table member 88 at axis point 93. Table member 88 is relatively free to pivot about axis 93 on top of rod 65; its range of movement being limited by the compressive strength of springs 87 and 86. Preferably, springs 86 and 87 fit into notches in the underside of table 88 and the topside of chassis block 14. These springs provide compressive resistance to table member 88 whenever it is pushed downward toward chassis block 14. As shown, rod 65 slides through opening 89 in block 14. Chassis block 14 is normally an integral part of the texturing apparatus chassis and rigidly establishes a vertical direction of motion for rod 65.

During loading and unloading of rollers 20, table member 88 functions as a sort of mechanical AND gate. To better understand the operation of the mechanical AND gate assembly of FIG. 9, consider the case in which members 81 and 82 are lowered in unison by stepper motors 85 and 84. As members 81 and 82 move down, they both contact the top of table member 88 at opposite ends. (The actual contact points in the preferred embodiment are via screws 94 and 95 threaded into members 81 and 82, respectively. In other embodiments, these screws may be omitted or substituted for without detracting from the basic operation.) Continued downward movement of members 81 and 82 forces table 88 down toward chassis block 14 against the resistance of springs 87 and 86. If members 81 and 82 are in complete unison then the top surface of table 88 will be roughly parallel to block 14. The downward action of table 88 pushes rod 65 down through openings 89 and 58 to unload the rollers as described above.

In the case where only one stepper motor is operating, or one is ahead of the other, a different result occurs. Assume that member 81 is ahead of member 82 and touches table 88 well before member 82 (as is illustrated by the dashed lines in FIG. 9). Because rod 65 is hinged to table 88, downward pressure by member 81 only succeeds in tilting table 88 without any downward force being applied to rod 65. Note that while spring 87 is compressed during the tilting of table 88, spring 86 is unaffected since it is unattached to either table 88 or to block 14. (Recall that springs 87 and 86 merely rest in slots or notches located in table 88 and block 14.)

Thus, the net impact of block 92, rod 65 and the described AND gate assembly is to load and unload the rollers with negligible initial force. To achieve this, the mechanism basically captures the load rollers and places them at a known position in space relative to the workpiece prior to loading/unloading. This allows a relatively close tolerance between the disk and the rollers (e.g., thirty thousands of an inch).

Whereas many alternations and modifications of the present invention will no doubt become apparent to a person of ordinary skill in the art after having read the foregoing description, it is to be understood that the particular embodiment shown and described by way of illustration is in no way intended to be considered limiting. For example, although this disclosure has shown a particular way of transferring force to the load rollers using a pair of pivot blocks mounted to the chassis, other implementations are possible. For instance, the present invention may be implemented using only one pivot block and one transverse shaft mounted to one side of the chassis. Therefore, reference to the details of the preferred embodiment are not intended to limit the scope of the claims which themselves recite only those features regarded as essential to the invention.

Thus, an apparatus for texturing the surfaces of a rigid-disk substrate used in magnetic recording systems has been described.

What is claimed is:

1. An apparatus for texturing the front and back surfaces of a rigid-disk substrate used in magnetic recording systems comprising:

means for rotating said substrate in a stationary plane;

first and second mechanical assemblies each including an abrasive tape, an load-bearing roller member, and means for moving said tape over said roller member;

means for applying a first force to each of said roller members to press said tape against said substrate surface, and for applying a second force to each of said roller members to distribute said first force across said substrate surface;

coupling network for mechanically coupling said first and second assemblies such that said first and second forces applied to said front substrate surface are identical to said first and second forces applied to said back substrate surface.

2. The apparatus of claim 1 wherein said applied forces are independent of the displacement or position of said substrate.

3. The apparatus of claim 2 further comprising means for bringing said tape to bear upon said substrate surface with negligible initial force.

4. An apparatus for texturing the surface of a rigid-disk substrate used in the magnetic recording comprising:

a chassis;

means for rotating said substrate in a stationary plane relative to said chassis;

a pair of mechanical assemblies attached to said chassis, one associated with each surface of said substrate, each assembly including:

an abrasive tape;

a means for pressing said tape against said substrate surface, said pressing means supplying a first force directed generally perpendicular to said substrate surface and a second force which distributes said first force across said tape;

a means for moving said pressed tape across said substrate surface to abrasively cut microscopic grooves therein;

and wherein said apparatus further comprises force management means coupled to said first and second assemblies for ensuring that the total force, comprising the sum of said first and second forces applied to each said surface of said substrate is identical.

5. The apparatus according to claim 4 wherein said management means also insures that said first, second and total forces are applied across the front the back surfaces of said substrate identically.

6. The apparatus of claim 5 wherein said first, second and total forces applied are independent of the displacement or position of said substrate.

7. The apparatus of claim 6 further comprising measurement means for measuring said first, second and total forces.

8. The appartus of claim 7 wherein said measurement means comprises a pair of strain gauges.

9. The apparatus of claim 8 further comprising a means for bringing said tape to bear upon said substrate surface with negligible initial force.

10. An apparatus for texturing the surface of a rigid-disk substrate used in magnetic recording systems, said apparatus including a chassis; rotation means for rotating said substrate in a stationary plane relative to said chassis; and a pair of assemblies for texturing the front and back surfaces of said substrate, wherein each assembly comprises:

a tape having an abrasive surface;

a load roller having two ends, a rotational axis and a cylindrically-shaped outer surface;

means for passing said tape between said load roller and said substrate;

mounting means for mounting said load roller to said chassis along said rotational axis and for positioning said outer surface of said load roller in close proximity to said surface of said substrate, said mounting means permitting a first movement of said load roller in a first direction approximately perpendicular to said stationary plane so as to allow said outer surface of said load roller to forcibly press said tape against said substrate surface, and a second rotational movement in a second rotational direction to allow one end of said load roller to press said tape against said substrate surface with greater force than that applied at the other end.

11. The apparatus according to claim 10 further comprising:

force application means coupled to said pair of assemblies for applying a direct force to each of the load rollers in said first direction and a skew force to each of the load rollers in said second rotational direction, the sum of said direct and skew forces producing a total force sufficient to cut circumferential grooves in said substrate surface; said direct, skew and total forces being identical on both said front and said back surfaces of said substrate.

12. The apparatus according to claim 11 wherein said direct, skew and total forces are applied to said front and back surfaces independent of the displacement of said substrate.

13. The apparatus according to claim 12 further comprising measuring means for measuring said direct skew and total forces.

14. The apparatus according to claim 13 wherein said mounting means comprises:

a bracket member having a first section mounted to said rotational axis of said load roller, and a second section;

first and second block members:

a longitudinal shaft having a first end secured to said first block member and a second end secured to said second block member, said longitudinal shaft extending through and freely rotating within said chassis thereby allowing said first and second block members to pivot in unison:

a first transverse shaft rotatably mounted to said first block member at a first end with said second end being coupled to said force application means;

a second transverse shaft having a first end rigidly attached to said second section of said bracket member and a second end extending through and freely rotating within said second block member such that when said direct force is applied to said first transverse shaft, said first and second block members pivot about said longitudinal shaft, thereby transferring said direct force to said load roller in said first direction;

means for transmitting rotational movement of said first transverse shaft to said second transverse shaft such that when said skew force is rotatably applied to said first transverse shaft, said second transverse shaft also rotates, thereby transferring said skew force to said load roller in said second rotational direction.

15. The apparatus according to claim 14 wherein said force application means comprises:

first and second stepper motors secured to said chassis;

a platform having a plurality of pulley wheels fixedly attached thereto;

first and second wing members each of which is attached to said second end of said first transverse shaft of their respective assemblies, each of said wing members having first and second ends;

first and second upper pulleys coupled to said first and second stepper motors,, respectively, said stepper motors operating to raise and lower said upper pulleys;

a first cable attached at one end of said first end of said first wing member and the other end attached to said first end of said second wing member;

a second cable attached at one end to said second end of said first wing member and attached at the other end to said second end of said second wing member;

said first cable threadably guided by at least two of said pulley wheels and said first upper pulley, said second cable also being threadably guided by at least two of said pulley wheels and said second upper pulley;

each of the recited elements cooperating such that whenever said first and second upper pulleys are raised in unison, said direct force is applied to each said second end of said first transverse shaft, and whenever one of said upper pulleys is raised independent of the other, said skew force is rotatably applied to each said second end of said first transverse shaft, said direct and skew forces being applied through said wing members.

16. The apparatus according to claim 15 further comprising means for bringing said tape to bear upon said substrate surface with negligible initial force.

17. The apparatus of claim 16 wherein said measurement means comprises a pair of strain gauges placed along said first and second sections of said bracket member.

* * * * *